US007575496B2

(12) United States Patent
Lau et al.

(10) Patent No.: US 7,575,496 B2
(45) Date of Patent: Aug. 18, 2009

(54) TOY WITH SPRING-LOADED, POP-OFF APPENDAGE ASSEMBLIES

(75) Inventors: Leon Lau, Shen Zhen (CN); Jamie Cheung, Shen Zhen (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/257,605

(22) Filed: Oct. 24, 2005

(65) Prior Publication Data

US 2006/0111013 A1 May 25, 2006

Related U.S. Application Data

(60) Provisional application No. 60/625,368, filed on Nov. 4, 2004, provisional application No. 60/626,350, filed on Nov. 8, 2004.

(51) Int. Cl.
*A63H 33/00* (2006.01)
*A63H 13/10* (2006.01)

(52) U.S. Cl. ..... 446/4; 446/308

(58) Field of Classification Search ..... 446/4–5, 446/97, 99, 101, 268, 308, 309, 311, 312, 446/330, 382, 376, 379, 6; 273/380, 383
See application file for complete search history.

(56) References Cited

U.S. PATENT DOCUMENTS

| | | | | | |
|---|---|---|---|---|---|
| 202,990 | A | | 4/1878 | Chinnock | |
| 324,233 | A | | 9/1885 | Coester | |
| 1,277,702 | A | * | 9/1918 | Des Combes | 273/380 |
| 2,385,724 | A | * | 9/1945 | Olson | 273/380 |
| 2,506,190 | A | | 5/1950 | Barnes | |
| 2,627,700 | A | | 2/1953 | Weiss | |
| 3,108,395 | A | * | 10/1963 | Goldfarb | 446/311 |
| 3,632,147 | A | * | 1/1972 | Finger | 403/171 |
| 3,792,858 | A | | 2/1974 | Eisenmann et al. | |
| 3,906,661 | A | | 9/1975 | Weiser | |
| 4,118,888 | A | * | 10/1978 | Ogawa | 446/92 |
| 4,125,961 | A | * | 11/1978 | Yamashina | 446/308 |
| 4,145,049 | A | * | 3/1979 | Papazian, Sr. | 273/351 |

(Continued)

FOREIGN PATENT DOCUMENTS

GB 2231261 A 11/1990

OTHER PUBLICATIONS

1993 Tyco Catalog Crash Dummies.

*Primary Examiner*—Gene Kim
*Assistant Examiner*—Alyssa M Hylinski
(74) *Attorney, Agent, or Firm*—Kolisch Hartwell, PC

(57) ABSTRACT

A toy locking mechanism, a toy releasing mechanism, and action figure toys that include the same. The toy locking mechanism may include first and second members having at least one corresponding pair of first and second locking elements forming nip regions. The locking mechanism may also include a third member having an end portion adapted to be retained in a nip region when the second member is in a locked position. A fourth member may be adapted to bias the second member toward the locked position. A fifth member may be adapted to be moved by a user relative to the first and second members, and may be adapted to contact the second member during movement to urge the second member toward an unlocked position. Some embodiments include a releasing mechanism adapted to urge the end portion of a third member away from an associated nip region.

21 Claims, 7 Drawing Sheets

U.S. PATENT DOCUMENTS 4,319,751 A 3/1982 Kurushima et al.
4,509,760 A * 4/1985 Goldfarb et al. ..... 273/380
4,565,537 A 1/1986 Klimpert et al.
4,673,367 A * 6/1987 MacBain ..... 446/4
5,087,219 A 2/1992 Price
5,100,327 A 3/1992 Gladish
5,334,073 A * 8/1994 Tilbor et al. ..... 446/308
5,380,231 A * 1/1995 Brovelli ..... 446/6
5,964,639 A 10/1999 Maxim
6,155,904 A 12/2000 Spector

* cited by examiner 14
18a
18b
20
23
66
68
70
74a
74b
76a
76b
78a
78b
80a
80b
84a
84b
86
90
95
100
102
106
112a
112b
114
116

TOY WITH SPRING-LOADED, POP-OFF APPENDAGE ASSEMBLIES

CROSS-REFERENCES

This application claims the benefit of U.S. Provisional Application No. 60/625,368, filed Nov. 4, 2004, and U.S. Provisional Application No. 60/626,350 filed Nov. 8, 2004. The contents of these disclosures are incorporated herein by reference in their entirety for all purposes.

FIELD OF THE DISCLOSURE

The present disclosure relates to toys that include appendages that are readily released or popped off of a base when a button on the base is depressed, and to the mechanisms included with these toys.

BACKGROUND

Action figure toys that include appendages, such as arms, legs, and a head that readily pop off of a torso when a button on the torso is depressed, have been popular for many years. For example, the button might be pushed by a child holding the action figure, or by an impact between the action figure and an obstacle such as a toy vehicle or building. Examples of action figures with pop-off appendages, or more generally toys with pop-off parts, are found in: U.S. Pat. Nos. 1,277,702; 2,385,724; 3,108,395; 4,118,888; 4,319,751; 5,100,327; and 5,334,073, the disclosures of which are hereby incorporated herein by reference in their entirety for all purposes.

The pop-off mechanisms of the present action figure may provide entertainment, because, when actuated, they release one or a multiple of appendage assemblies from the torso in simultaneous or randomly sequential order, and may forcibly eject the appendage assemblies away from the torso.

SUMMARY OF THE DISCLOSURE

Some embodiments include a toy locking mechanism having at least a first member with at least one first locking element, and a second member that moves relative to the first member between locked and unlocked positions. The second member may have at least one second locking element disposed at a position aligned with the at least one first locking element and that forms at least one nip region. The locking mechanism may also include one or more additional members. For example, one or more third member may each have an end portion adapted to be retained in the at least one nip region when the second member is in the locked position. A fourth member may be adapted to bias the second member toward the locked position. A fifth member, which may be moved by a user relative to the first and second members, may be adapted to contact the second member during movement in a first direction to urge the second member toward the unlocked position. Some embodiments include a releasing mechanism adapted to urge the end portion of one or more third members away from one or more nip regions.

Some embodiments provide a mechanism for releasing parts of a toy, including at least one first member having an end portion, a second member that is movable between releasing and non-releasing positions and a third member. When the second member moves toward the releasing position in a first direction, the second member pushes against the end portion of the at least one first member to urge the at least one first member away from the second member. The third member biases the second member toward the releasing position.

Some embodiments provide an action figure toy including the provided locking and/or releasing mechanisms.

DETAILED DESCRIPTION

Figure 2:
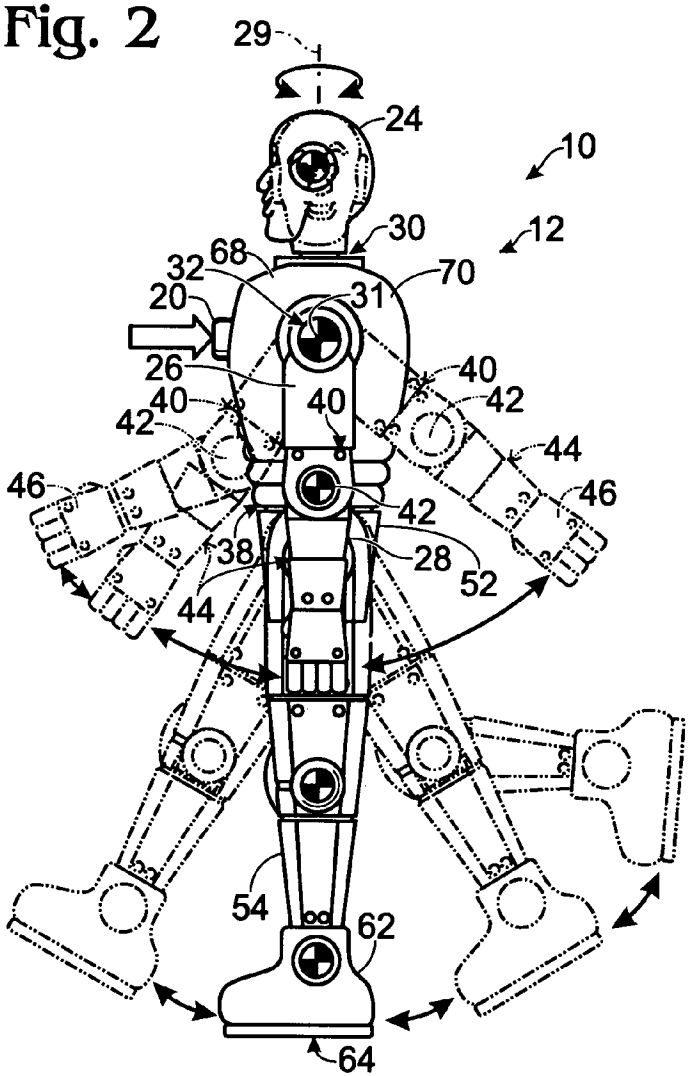
FIG. 2 is a side elevation view of the action figure toy of FIG. 1, showing rotation at neck and shoulder joints, as well as articulation of elbow, hip, and knee joints.
Figure 1:
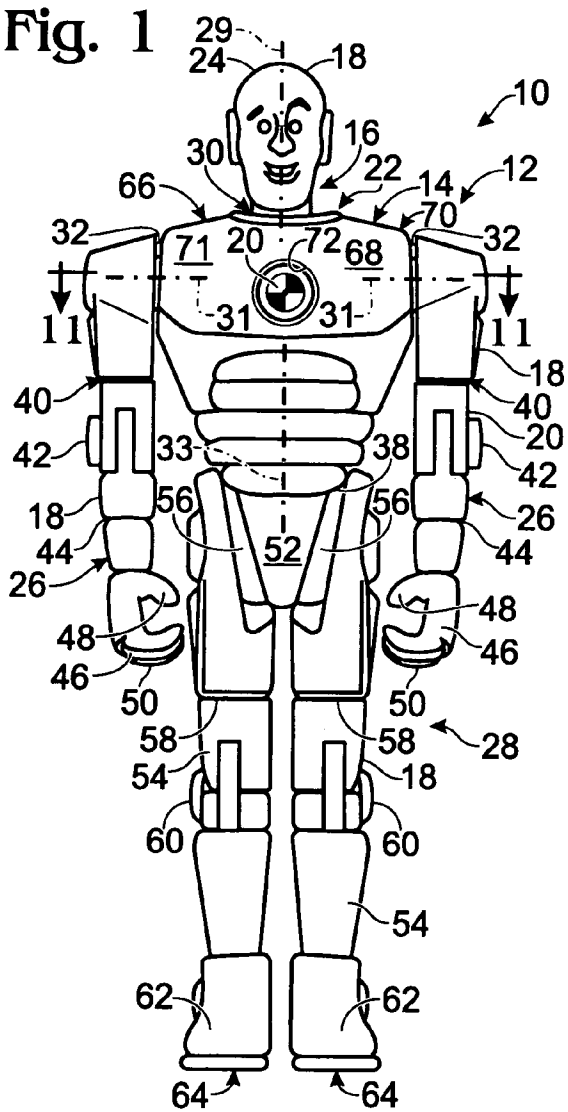
FIG. 1 is a front elevation view of an action figure toy.
Figure 3:
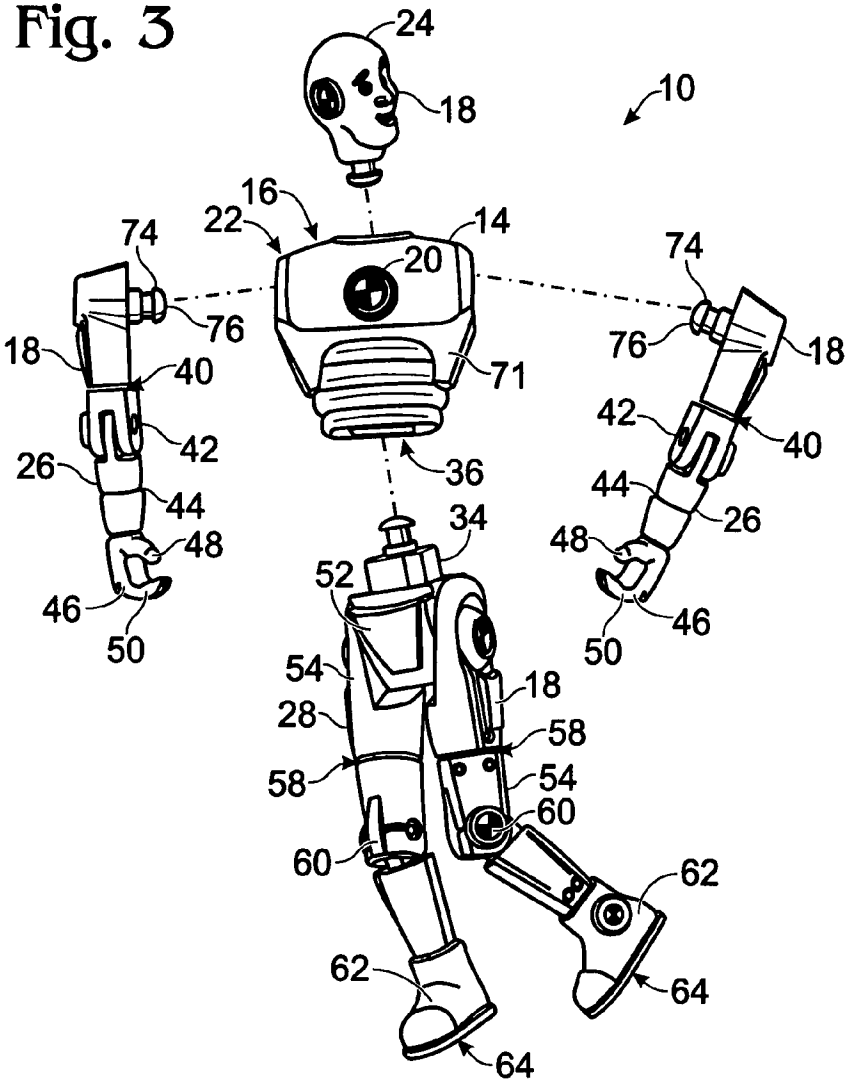
FIG. 3 is an exploded view of the action figure toy of FIG. 1, showing head, arms and leg-assembly appendage assemblies ejected in random order and each in slightly random directions.

An illustrative example of an action figure toy with pop-off spring loaded appendages is shown in FIGS. 1-3 and indicated generally at 10. Action FIG. 10 includes a generally human-shaped body 12 that includes a torso 14, or other suitable member, and a retaining or locking mechanism 16, which is adapted to releasably retain one or a plurality of other members, such as appendage assemblies 18, to member or torso 14. Locking mechanism 16 may also include an actuator 20. Alternatively or additionally, action figure toy 10 may include a releasing mechanism 22, or a combination locking and releasing mechanism 23. Releasing mechanism 22 or combination mechanism 23 may also include an actuator 20. A locking mechanism, a releasing mechanism, and a combination mechanism are shown and described with reference to a particular structure, and in particular with reference to an action figure toy. Locking mechanisms, releasing mechanisms, and/or combination mechanisms may be used on other types of toys having at least one releasable member.

In this example, appendage assemblies 18 may include a head 24, two arms 26, and a leg assembly 28. Locking mechanism 16 or combination mechanism 23 may be adapted such that appendage assemblies 18 each may be rotatably attached to torso 14. Specifically, head 24 may be rotated about an axis 29 at neck joint 30, and arms 26 may be rotated about an axis 31 at shoulder joints 32, when retained by locking mechanism 16 or combination mechanism 23. Leg assembly 28 may also rotate about an axis 33, or it may include an insert 34 that fits into socket 36, like a key and keyway, to prevent rotation of leg assembly 28 about waist joint 38.

Arms 26 and leg assembly 28 may include articulating joints that allow the action figure to be posed by a user during play activities. Specifically, arms 26 may each include a rotatable upper arm joint 40, bendable elbow joint 42, and rotatable forearm joint 44. Arms 26 may each also include a hand 46 that is shaped to grasp objects or accessory toys, such as steering wheels or bars, between thumb 48 and fingers 50.

Leg assembly 28 may also include a lower torso 52 to which legs 54 are each attached at a rotational hip joint 56. Optionally, legs 54 may join directly with torso 14 with leg joints similar to shoulder joints 32. Legs 54 may each further include a rotatable thigh joint 58 and a bendable knee joint 60. Legs 54 may each include a boot 62 that may be positioned onto a peg of an accessory toy, using a hole 64 in the bottom of boot 62.

Torso 14, head 24, arms 26, and leg assembly 28 may be constructed from materials such as plastic, and may comprise several parts joined together by sonic welds or glue, by press-fit, or by other suitable techniques. Locking mechanism 16 and releasing mechanism 22, or alternatively combination mechanism 23, each may comprise several components which may be fabricated from suitable materials such as plastic or metallic materials, and may be movably mounted within a torso cavity or hollow interior 66, which is formed by joining a front segment 68 with a back segment 70 of torso shell 71. As shown, front segment 68 and back segment 70 each comprise substantially half of torso shell 71. In other configurations, each segment may comprise more or less than half of shell 71. Front segment 68 may include a hole or aperture 72 through which actuator 20 may pass to actuate locking mechanism 16, releasing mechanism 22, or combination mechanism 23.

Figure 5:
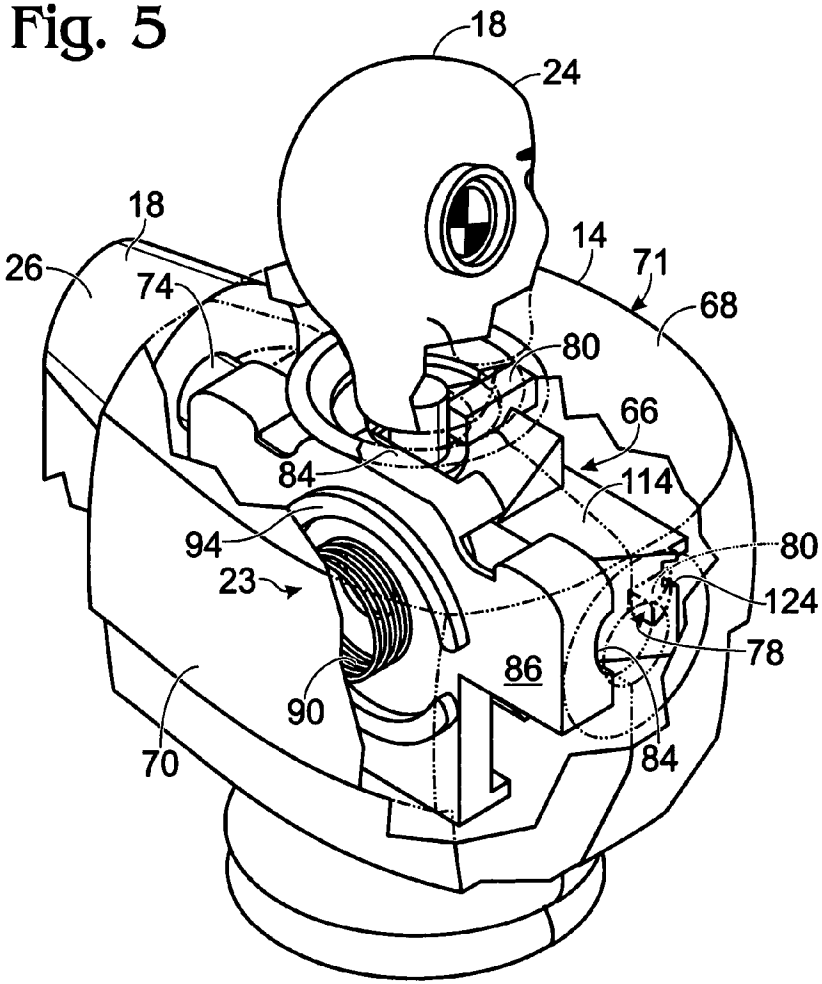
FIG. 5 is a rear partial cutaway isometric view of a portion of the action figure toy of FIG. 4.
Figure 4:
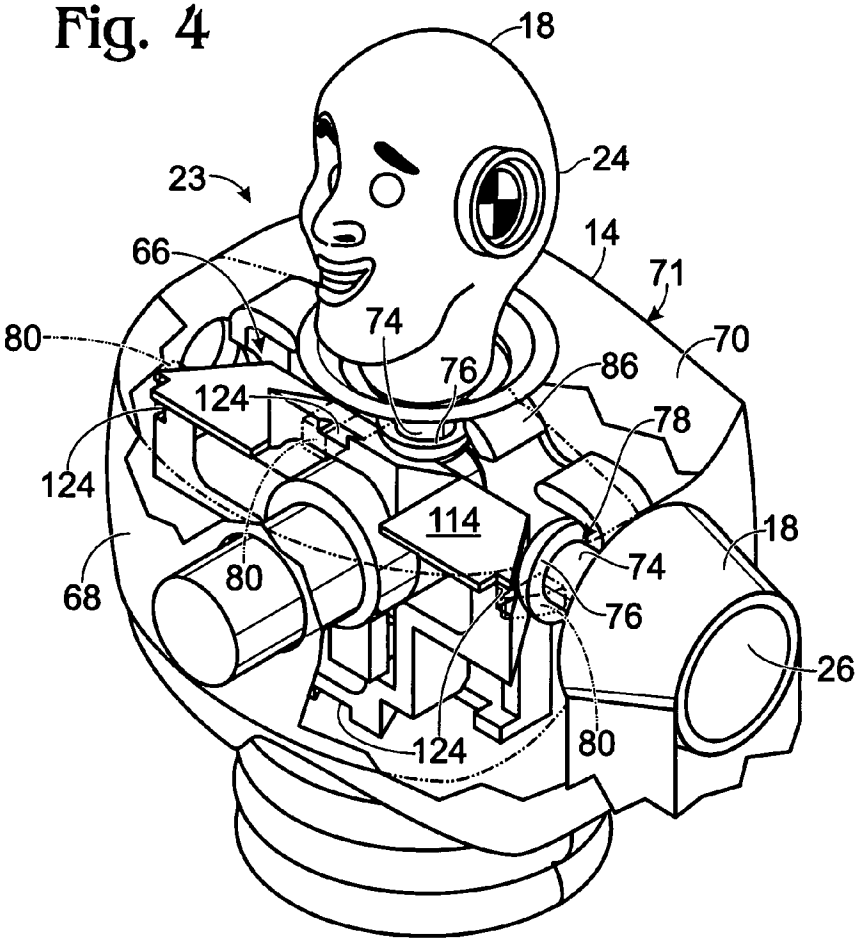
FIG. 4 is a frontal partial cutaway isometric view of a portion of the action figure toy of FIG. 1, showing a locking mechanism and a releasing mechanism provided in a torso portion of the action figure toy.

FIGS. 4-16 show these examples of locking mechanism 16 and releasing mechanism 22 in detail. Locking mechanism 16 and releasing mechanism 22 are illustrated as a combination mechanism 23, although this is not required. Shown in FIGS. 4-5 are two appendage assemblies 18 and a portion of combination mechanism 23, specifically those associated with retaining head 24 and one arm 26. Head 24 and arm 26 are each shown to include a connector, or end portion, 74 disposed at one end, and including a mushroom-shaped head end 76. Connectors 74 are each retained in a nip region 78 formed by a raised ledge 80 on an interior surface 82 of torso front segment 68 and a locking edge 84 formed on a locking plate 86. Each locking edge 84 may be disposed at a position aligned with each raised ledge 80, and raised ledge 80 and locking edge 84 generally contact each connector 74 under mushroom-shaped head end 76 on opposing sides.

Locking plate 86 is shown in FIGS. 4-5 in a locked position within torso cavity 66 and may be movable relative to the front segment 68 of torso shell 71 between this locked position and an unlocked position. Torso front segment 68 may include a plurality of plate guides 88 (best seen in FIG. 7) that prevent lateral movement of locking plate 86 within torso cavity 66, but allow locking plate 86 to pivot under the floating, spring-loaded nature of locking mechanism 16, or combination mechanism 23, and move toward and away from front segment 68. Locking compression spring 90 is shown positioned between torso shell back segment 70 and locking plate 86 and may be adapted to bias the locking plate toward the locked position. Torso shell back segment 70 may include a substantially circular guide 92 to hold compression spring 90 in place. Similarly, locking plate 86 may also include a substantially circular guide 94. Whereas the present example uses a compression spring to bias the locking plate, any biasing member, such as a leaf spring, may be used.

Actuator 20 may be moveable along an actuator axis 95 relative to torso shell front segment 68 and locking plate 86, and may include a shaft, or elongated portion, 96 that is adapted to contact and urge locking plate 86 toward the unlocked position. Shaft 96 may include a wide central segment 98 and a narrow end segment 100. Narrow end segment 100 is adapted to fit within a locking plate aperture 102 formed in locking plate 86, whereas wide central segment 98 is too large to fit through the aperture. Aperture 102 may have a dimension 104 that is between a dimension 103 of wide central segment 98 and a dimension 105 of narrow end segment 100. As a result, the narrow end segment may be insertable into the aperture until the shaft contacts locking plate 86 without the wide central segment entering the aperture.

As shown, locking plate aperture 102 has a generally circular shape. Similarly, both wide central segment 98 and narrow end segment 100 are also shown to be cylindrical in shape with a generally circular cross-section. Shaft 96 is shown to include a shelf 106 at the transition point between wide central segment 98 and narrow end segment 100. Although the cross-section of shaft 96 and the shape of aperture 102 are shown as circular, other shapes are within the scope of this disclosure. Similarly, although wide central segment 98 and narrow end segment 100 are shown to have constant diameters, other arrangements, such a constantly increasing diameter for shaft 96 with no shelf 106, are within the scope of this disclosure.

Figure 8:
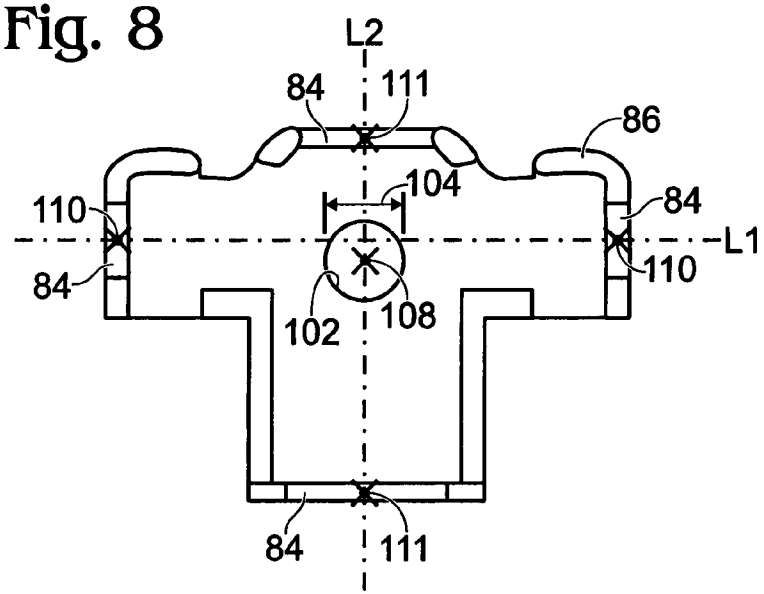
FIG. 8 is a front elevation view of locking plate of the action figure toy of FIG. 1.

As also shown particularly in FIG. 8, in this example, actuator axis 95, which passes through a center 108 of locking plate aperture 102 is spaced from a line L1 drawn between the midpoints 110 of arm locking edges 84. Also in this example, center 108 is located on a line L2 drawn between the midpoints 111 of head locking edge 84 and leg assembly locking edge 84. In other examples, center 108 may lie on both lines L1 and L2, on L1 but not L2, or on neither of these lines. As relates to the present example, center 108 may lie on actuator axis 95, but actuator axis 95 may intersect line L1, line L2, or both of these lines. Optimally, axis 95 may not contain center 108 and may not intersect line L1, line L2, or both of these lines.

Figure 9:
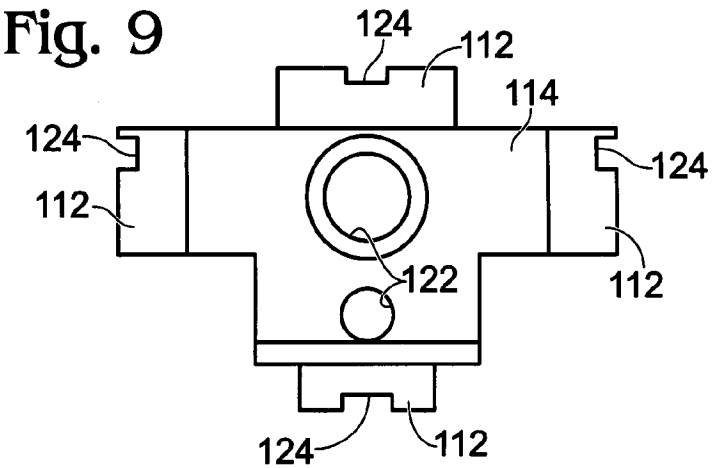
FIG. 9 is a rear elevation view of the ejecting plate of the action figure toy of FIG. 1.

When connectors 74 are retained by locking mechanism 16 or combination mechanism 23, each mushroom shaped head end 76 of each connector 74 may be biased outwardly by an edge 112 of ejecting plate 114 that is angled traversely relative to the direction of movement of actuator 20. Connectors 74, when released from nip regions 78, may be urged away from the nip regions by angled edges 112. Although edges 112 are shown in FIG. 9 as planar surfaces, other configurations, such as curved and/or multi-planar surfaces, may be used. The angle at which angled edges 112 push connectors 74 may be varied, but will generally be transverse to the direction of movement of either actuator 20, locking plate 86, or ejecting plate 114. For example, angled edges may form an angle between 20 and 70 degrees with the direction of movement of actuator 20, and, in particular, an angle of 45 degrees may be used. Like locking plate 86, ejecting plate 114 may be restrained from lateral movement within torso cavity 66 such as by plate guides 88, but allowed to pivot under the floating, spring-loaded nature of releasing mechanism 22 or combination mechanism 23.

Figure 6:
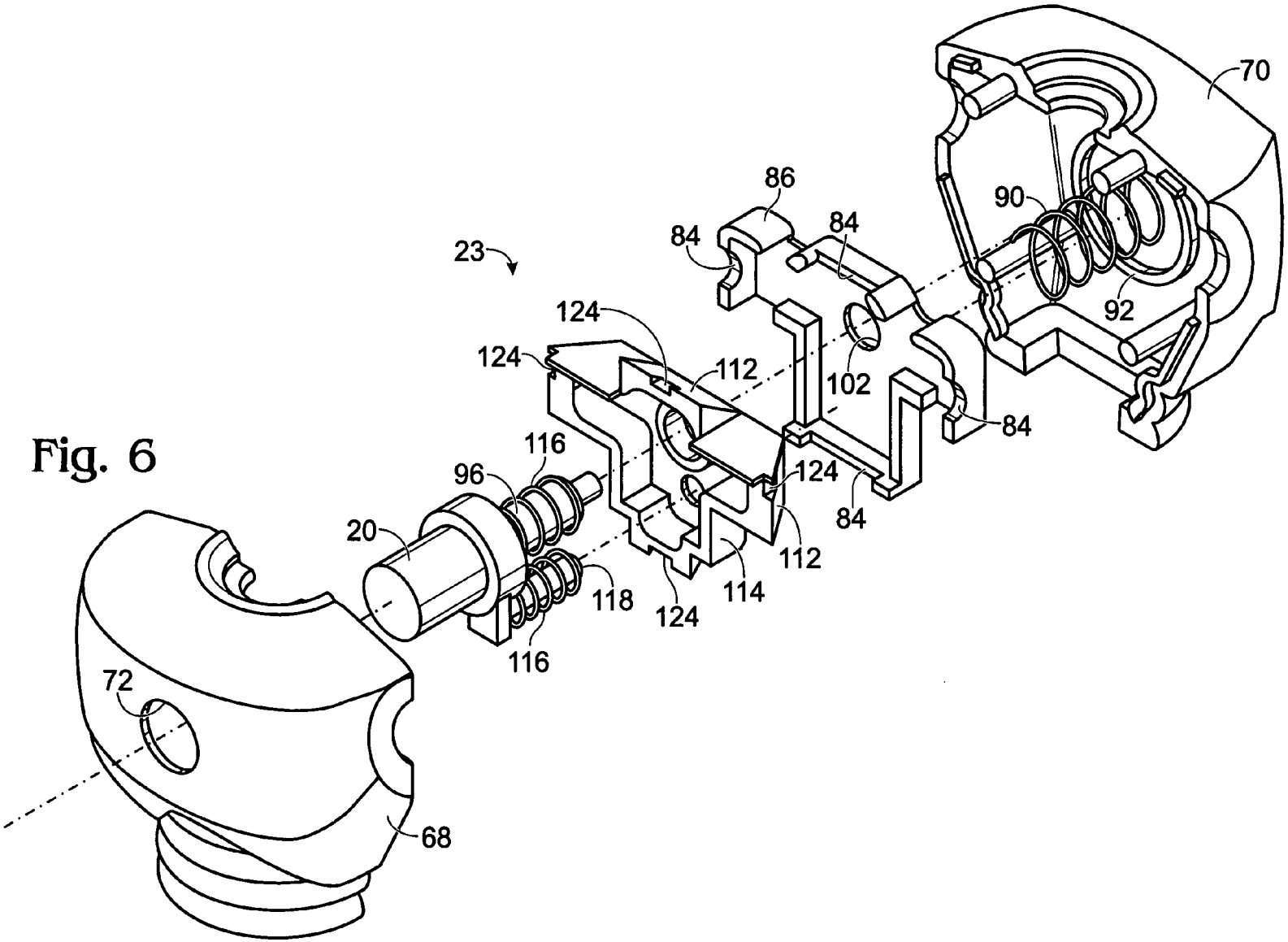
FIG. 6 is an exploded view of torso parts of the action figure toy of FIG. 1, viewed from the front of the action figure toy.
Figures 7, 10:
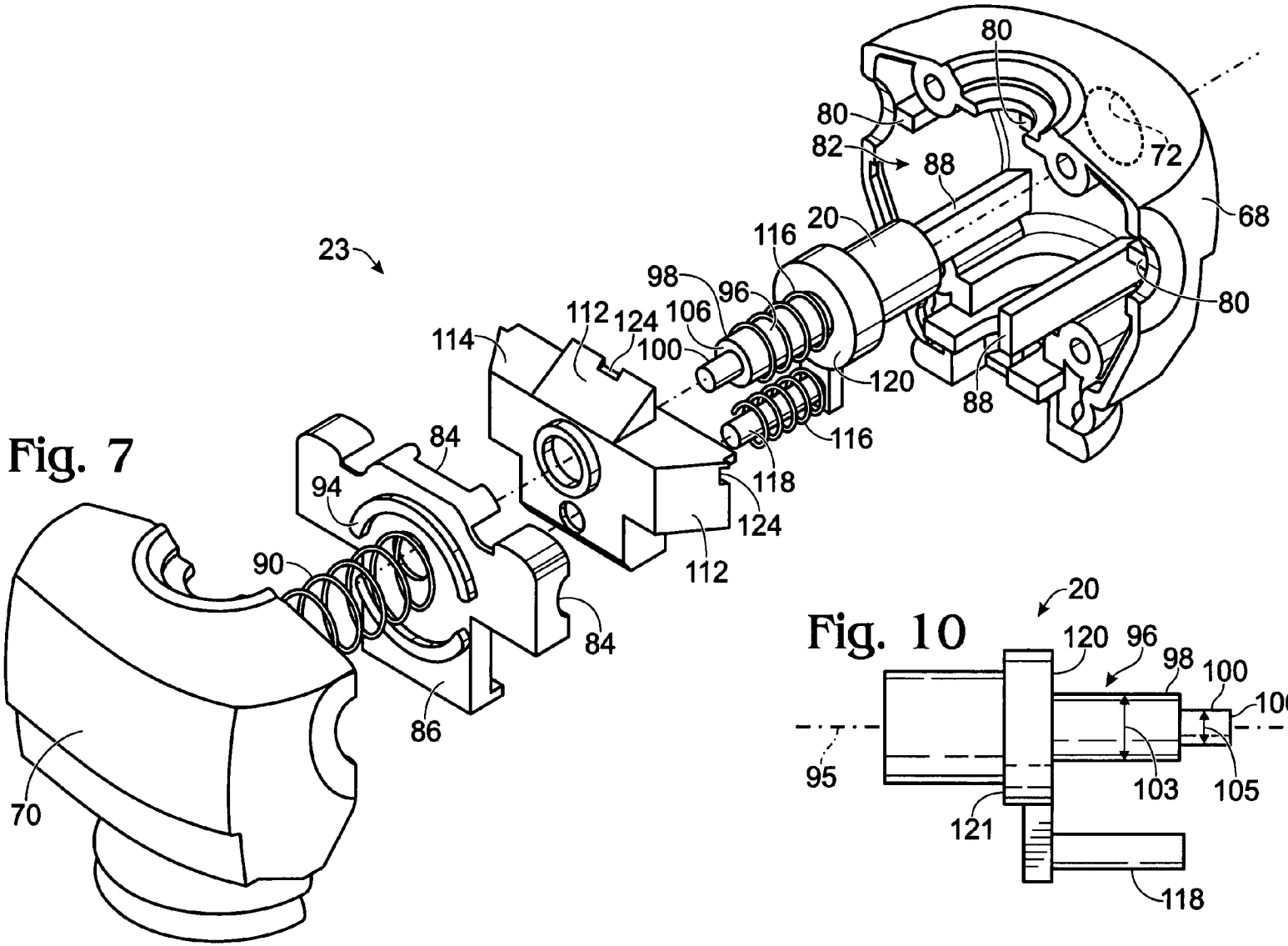
FIG. 7 is an exploded view of torso parts of the action figure toy of FIG. 1, viewed from the rear of the action figure toy.
FIG. 10 is a side elevation view of an actuator of the action figure toy of FIG. 1.

Ejecting plate 114 may be biased relative to torso shell front segment 68, locking plate 86, and actuator 20 between an releasing position and a non-releasing position under the bias of at least one ejecting compression spring 116. A spring 116 may surround shaft 96, one or more posts, such as post 118, or both. FIGS. 6-7 show two ejecting compression springs 116 and show a cylindrical post 118 formed integral with actuator 20 and having a circular cross-section. Ejecting compression springs 116 are each shown positioned between ejecting plate 114 and a ridge 120 of actuator 20 such that movement of actuator 20 toward locking plate 86 increases the bias of ejecting springs 116 on ejecting plate 114. Ejecting springs 116, when positioned in this manner, may bias actuator 20 toward a position where a maximum amount of actuator 20 is showing on the exterior of torso 14, as occurs when flange 121 is pressed against torso front segment 68. While two ejecting compression springs 116 are shown, more or fewer ejecting compression springs 116 may be used. Moreover, where the present example uses a compression spring to bias the ejecting plate, any biasing member such as a leaf spring may be used.

Ejecting plate 114 may also include an aperture 122 corresponding to each of or both of shaft 96 or post 118 so that actuator 20 may move independently of ejecting plate 114. As shown particularly in FIG. 9, ejecting plate 114 has two generally circular apertures 122 that have diameters that are larger than the corresponding diameter of shaft 96 or post 118. As shown in FIG. 10, post 118 may be sufficiently shorter than shaft 96 such that post 118 does not contact locking plate 86 as actuator 20 is depressed.

Ejecting plate 114 may also include notches 124 that fit around raised edges 80. Notches 124 allow angled edges 112 to have a maximum surface area while also allowing ejecting plate 114 to move freely between the releasing and non-releasing positions.

Figures 11, 12, 13, 14, 15, 16:
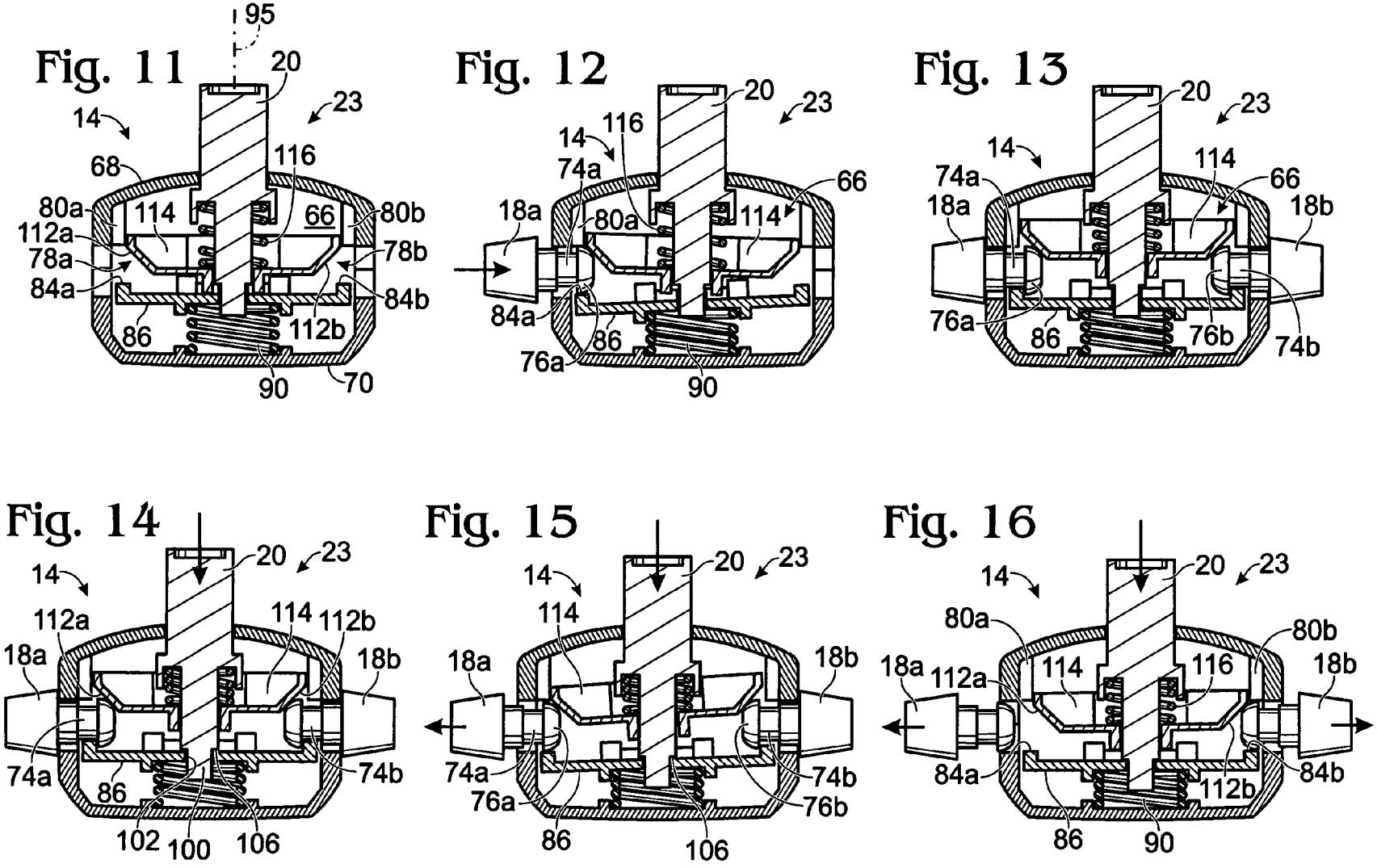
FIGS. 11-16 are cross-sectional views of the torso of the action figure of FIG. 1, taken along line 11-11, showing various stages of operation.

FIGS. 11-16 show the operation of combination mechanism 23 in detail, with reference to an action figure toy, as viewed from the plane represented by line 11-11 in FIG. 1. FIG. 11 shows torso 14 in an empty or rest state, with no appendage assemblies 18 retained. Locking plate 86 is biased toward the locked position by locking compression spring 90, and presses against ejecting plate 114. The ejecting plate is biased toward the releasing position by ejecting compression springs 116. The position of locking plate 86 and ejecting plate 114 within torso cavity 66 may be determined by a balance between locking compression spring 90 and ejecting compression springs 116. Actuator 20 is fully extended due to the collective bias of compression springs 90 and 116.

FIG. 12 shows torso 14 with one connector 74*a* of an appendage assembly 18*a* in the process of being inserted into a nip region 78*a*. Mushroom-shaped head end 76*a* of connector 74*a* is shown not yet engaged by raised ledge 80*a* or locking edge 84*a*. Locking plate 86 and ejecting plate 114 are shown pivoting within torso cavity 66 to accommodate mushroom-shaped head end 76*a*. As in FIG. 11, actuator 20 is fully extended due to the collective bias of compression springs 90 and 116.

FIG. 13 shows the two appendage assemblies 18*a* and 18*b* locked to torso 14, with the mushroom-shaped head ends 76*a* and 76*b* of connectors 74*a* and 74*b* of both appendage assemblies grasped in nip regions 78*a* and 78*b* between raised ledges 80*a* and 80*b* and locking edges 84*a* and 84*b* of locking plate 86. Locking plate 86 is biased toward the locked position by locking compression spring 90. Ejecting plate 114 is biased toward the releasing position by ejecting compression springs 116. Angled edges 112*a* and 112*b* of ejecting plate 114 are contacting mushroom-shaped head ends 76*a* and 76*b*. Actuator 20 is fully extended due to the collective bias of compression springs 90 and 116.

FIGS. 14-16 show the movement of combination mechanism 23 resulting from depressing actuator 20 with two appendage assemblies 18 locked in place. FIG. 14 shows actuator 20 in a partially depressed state. Actuator 20 is positioned such that narrow end segment 100 is inserted into aperture 102 and shelf 106 has just contacted locking plate 86. In the position shown, actuator 20 has not yet caused locking plate 86 to move from the locked position and connectors 74*a* and 74*b* remain grasped firmly in nip regions 78*a* and 78*b*. Angled edges 112*a* and 112*b* of ejecting plate 114 are contacting mushroom-shaped head ends 76*a* and 76*b*.

Further depression of actuator 20 will cause shaft 96 to urge locking plate 86 toward the unlocked position, as shelf 106 pushes upon locking plate 86. As locking plate 86 is moved toward the unlocked position, locking edges 84 may grab onto less of mushroom-shaped head ends 76. FIG. 15 shows a first connector 74*a* released from a first nip region 78*a*, as the corresponding locking edge 84*a* has moved sufficiently to allow angled edge 112*a* of ejecting plate 114 to push against the connector to propel the connector away from nip region 78*a* in a direction transverse to the direction of movement of the locking plate 86. A second connector 74*b* is shown just barely grasped in its corresponding nip region 78*b*. As a result, the locking plate 86 and ejecting plate 114 are each positioned at slight angles from the positions shown in FIGS. 13-14, which is possible due to the floating nature of combination mechanism 23.

FIG. 16 shows actuator 20 fully depressed. Locking plate 86 is positioned in an unlocked position, and once again parallel to the position of FIGS. 13-14, with locking compression spring 90 fully loaded. Since both shown locking edges 84*a* and 84*b* have released their grip on both shown mushroom-shaped head ends 76*a* and 76*b*, connectors 74*a* and 74*b* have been ejected from nip regions 78*a* and 78*b* by angled edges 112*a* and 112*b* of ejecting plate 114, and are free to move independently of combination mechanism 23. Ejecting plate 114 is shown part way to a position resting against locking plate 86, but still at an angle relative to its position in FIGS. 13-14. Under the influence of ejecting springs 116, ejecting plate 114 will come to rest against, and parallel to, locking plate 86. When actuator 20 is released, the parts of combination mechanism 23 will return to the positions shown in FIG. 11.

While the various parts of action figure toy 10 are shown in FIGS. 1-16 in detail, it will be appreciated that variations are possible while maintaining one or more of the features of the disclosed toy. For example, the angled edges 112 of ejecting plate 114 and mushroom-shaped head ends of connectors 74 may be altered such as by interchanging the corresponding geometry, by having matching hemispherical or cylindrical surfaces, by matching angled or conical surfaces, or by even varying the relative dimensions. These or other variations may also be applied to any subset, or all of appendage assemblies 18.

In yet another alternative embodiment, ejecting plate 114 may be more rectangular, or may be eliminated completely, so that no outward pressure is created on connectors 74, or only on selected ones of connectors 74. Thus, all or selected appendage assemblies simply fall off or are removed by a user of action figure toy 10, rather than being forcibly ejected from torso 14. Similarly, a releasing mechanism may not be provided, or may be provided independently of a locking mechanism. Additionally or alternatively, locking plate 86 may be eliminated or altered such that all or selected ones of connectors 74 are not retained in a nip region 78, and the corresponding appendage assemblies 18 are free to be acted upon by a releasing mechanism 22.

Figure 17:
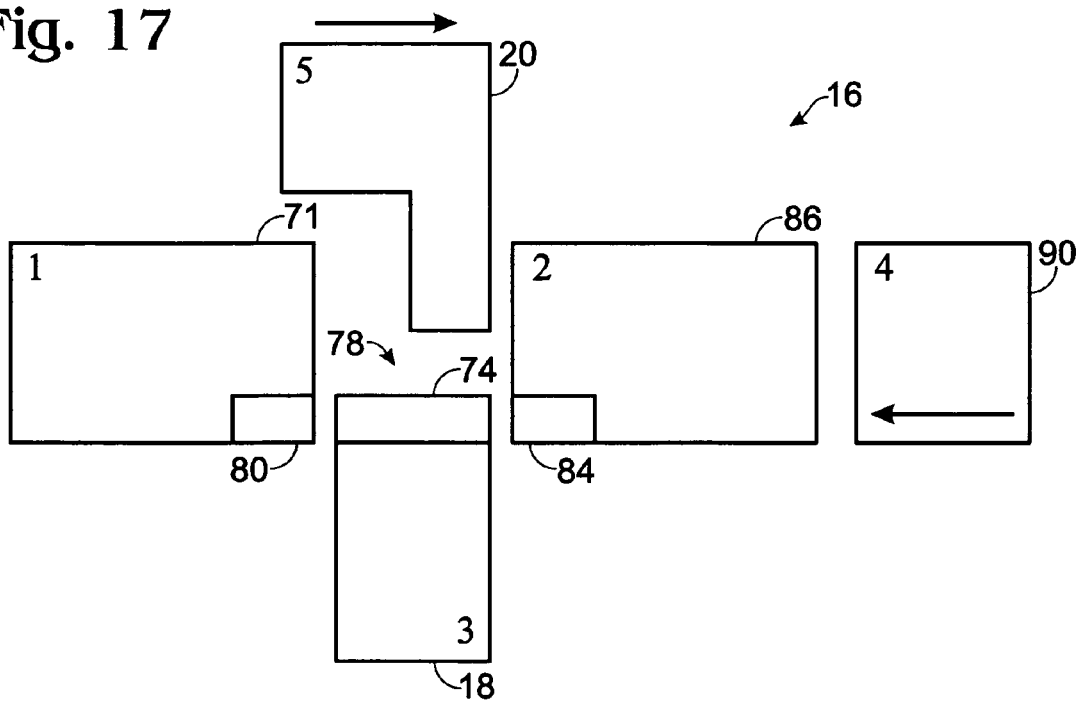
FIG. 17 is schematic drawing of a toy locking mechanism.

A generalized embodiment of a toy locking mechanism 16 is shown in FIG. 17. Toy locking mechanism 16 includes a first member 71 having at least one first locking element 80 and a second member 86, with the second member moveable relative to the first member between locked and unlocked positions. The second member may have at least one second locking element 84 disposed at a position opposing the at least one first locking element and forming with the at least one locking element at least one nip region 78. The toy locking mechanism may also include at least one third member 18 having an end portion 74 adapted to be retained in the at least one nip region when the second member is in the locked position. A fourth member 90 may be adapted to bias the second member toward the locked position. A fifth member 20, which may be moved by a user relative to the first and second members, may be adapted to contact the second member during movement in a first direction to urge the second member toward the unlocked position.

Figure 18:
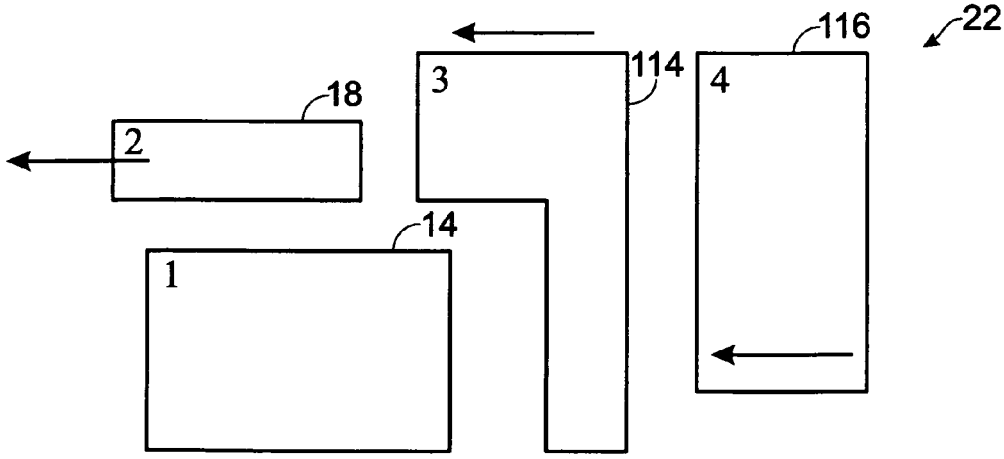
FIG. 18 is schematic drawing of a toy releasing mechanism.

A generalized embodiment of a toy releasing mechanism 22 is shown in FIG. 18. Toy releasing mechanism 22 includes a first member 14 and at least one second member 18 releasably supported on the first member. The releasing mechanism may also include a third member 114 that is movable relative to the first member between releasing and non-releasing positions. When the third member is moved toward the releasing position, the third member may push against the at least one second member to propel the at least one second member away from the third member when the third member is released from the first member. A fourth member 116 may bias the third member toward the releasing position.

Toys of any configuration having separable members may have two or more of the separable members locked with a locking mechanism as described. Alternatively or additionally, these toys may have one or more of the separable members released from another with a releasing mechanism as described, or may include other features described herein.

The pop-off mechanisms of the present action figure may provide entertainment, because, when actuated, they release one or a multiple of appendage assemblies from the torso in simultaneous or randomly sequential order, and may forcibly eject the appendage assemblies away from the torso.

While embodiments of action figure toys with pop-off spring loaded appendages have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to toys, such as dolls, action figures, games, and other devices, and other industries in which amusement devices are used.

We claim:

1. A toy locking mechanism comprising:

a first member having at least one first locking element;

a second member moveable relative to the first member between locked and unlocked positions, the second member having at least one second locking element disposed at a position opposing the at least one first locking element and forming with the at least one first locking element at least one nip region, the second member also having a locking plate that includes an aperture with a dimension;

at least one third member having an end portion adapted to be retained in the at least one nip region when the second member is in the locked position;

a fourth member biasing the second member toward the locked position; and a fifth member movable by a user relative to the first and second members and including an elongated portion having a wide segment with a dimension larger than the aperture dimension, and a narrow segment with a dimension smaller than the aperture dimension, and that is adapted to contact the second member during movement in a first direction such that the narrow segment extends through the aperture and the wide segment contacts the locking plate to urge the second member toward the unlocked position.

2. The toy locking mechanism of claim 1, wherein the at least one third member is free to rotate about an axis when the end portion is retained in the at least one nip region.

3. The toy locking mechanism of claim 1, wherein the first member includes a plurality of first locking elements, the second member includes a plurality of second locking elements that are each paired with a corresponding first locking element and that are disposed at a position aligned to the corresponding first locking element forming a plurality of nip regions to retain the end portion of a corresponding end portion of each of a plurality of third members.

4. The toy locking mechanism of claim 1, wherein the wide segment contacts the locking plate without extending through the aperture.

5. The toy locking mechanism of claim 4, wherein there are two opposing second locking elements each having a midpoint, and the wide segment is adapted to be moved relative to the locking plate along an axis that is spaced from a line drawn between the midpoints of the two opposing second locking elements.

6. The toy locking mechanism of claim 1, which further comprises a releasing mechanism adapted to urge the end portion of each of the at least one third member away from the associated nip region.

7. The toy locking mechanism of claim 6, wherein the releasing mechanism comprises:

a sixth member that is movable relative to the first second, and fifth members between releasing and non-releasing positions, such that, when the sixth member moves toward the releasing position in a second direction, the sixth member pushes against the end portion of the one or more third member to propel the end portion away from the associated nip region; and a seventh member adapted to bias the sixth member toward the releasing position.

8. The toy locking mechanism of claim 7, wherein the seventh member is disposed between the fifth member and the sixth member such that movement of the fifth member in the first direction increases the bias that the seventh member imparts on the sixth member.

9. The toy locking mechanism of claim 8, wherein the sixth member includes an ejecting plate having at least one edge which is angled relative to the second direction) such that the at least one edge presses against the end portion of the associated at least one third member to propel the end portion of the associated at least one third member away from the at least one nip region in a direction transverse to the second direction.

10. The toy locking mechanism of claim 9, wherein the first member includes a plurality of first locking elements, the at least one third member includes a plurality of third members, and the second member includes a plurality of second locking elements that are each paired with a corresponding first locking element and that are disposed at a position aligned to the corresponding first locking element and forming a plurality of nip regions to retain the end portion of a corresponding third member of the plurality of third members; and wherein the ejecting plate has plural edges that each press against the end portion of an associated third member to propel the end portion away from the nip region in a direction transverse to the second direction.

11. An action figure toy comprising the toy locking mechanism of claim 1 and a torso, wherein the torso encloses the locking mechanism, and wherein the third members are appendage assemblies.

12. A toy releasing mechanism for releasing parts of a toy, comprising:

a first member;

at least one second member releasably supported on the first member;

a third member that includes an ejecting plate and that is movable relative to the first member between releasing and non-releasing positions, such that, when the third member is moved toward the releasing position in a first direction, an edge of the electing plate pushes against an end portion of the at least one second member in a direction transverse to the first direction to propel the at least one second member away from the third member when the second member is released from the first member; and a fourth member that biases the third member toward the releasing position.

13. The toy releasing mechanism of claim 12, wherein the third member includes plural elements which each push against the end portion of a corresponding second member of a plurality of second members.

14. The toy releasing mechanism of claim 13, wherein the third member moves in a first direction toward the releasing position, and includes an ejecting plate having a plurality of edges with each pressing against an end portion of an associated second member in a direction transverse to the first direction.

15. An action figure toy comprising the toy releasing mechanism of claim 12 and a torso, wherein the torso includes the first member, and wherein the second members are appendage assemblies.

16. A combination locking and releasing mechanism for a toy comprising:

a first member having a plurality of first locking elements;

a second member that moves relative to the first member between a locked position and an unlocked position, the second member including a locking plate having a plurality of second locking elements that each have a midpoint, the second locking elements each being paired with a corresponding first locking element, and each being disposed at a position aligned to the corresponding first locking element forming a plurality of nip regions, the locking plate also having an aperture having a dimension and a center, the center being spaced from a line drawn between the midpoints of two opposing second locking elements;

a plurality of third members each having an end portion adapted to be retained in a corresponding nip region when the second member is in the locked position;

a fourth member adapted to bias the second member toward the locked position;

a fifth member that is moved by a user relative to the first and second members and that is adapted to contact the second member during movement in a first direction to urge the second member toward the unlocked position, the fifth member including an elongated portion having a wide segment with a dimension larger than the dimension of the aperture, and a narrow segment with a dimension smaller than the dimension of the aperture such that, when the fifth member contacts the second member, the narrow segment is inserted through the aperture until the elongated portion contacts the locking plate without the wide segment entering the aperture;

a sixth member that is movable relative to the first, second, and fifth members between a releasing position and a non-releasing position, the sixth member including an ejecting plate having plural edges that are each associated with the end portion of a corresponding third member, the edges being angled relative a the second direction such that, when in the sixth member is moved in the second direction toward the releasing position, the edges each push against the end portion of the associated third member to propel the associated third member away from the associated nip region in a direction that is transverse to the second direction; and a seventh member that biases the sixth member toward the releasing position, the seventh member being disposed between the fifth member and the sixth member such that movement of the fifth member in the first direction increases the bias that the seventh member imparts upon the sixth member.

17. An action figure toy comprising the toy combination mechanism of claim 16 and a torso, wherein the third members are appendage assemblies.

18. The action figure toy of claim 17, wherein the torso has an exterior, a hollow interior, and an interior surface, wherein the first locking elements are disposed on the interior surface of the torso, wherein the second, fourth, sixth, and seventh members are disposed in the hollow interior of the torso, and wherein the fifth member is exposed on the exterior of the torso.

19. The action figure toy of claim 18, wherein the torso is human shaped.

20. The action figure toy of claim 19, wherein the appendage assemblies include a head, two arms, and at least one leg assembly.

21. The action figure toy of claim 19, wherein at least one of the appendage assemblies includes at least one articulating joint.

* * * * *